US006739004B1

(12) United States Patent
Abrahamsen et al.

(10) Patent No.: US 6,739,004 B1
(45) Date of Patent: May 25, 2004

(54) ROTARY ACTUATOR, ESPECIALLY FOR ADJUSTABLE FURNITURE, INCLUDING BEDS AND BOTTOM FOR BEDS

(75) Inventors: John Abrahamsen, Nordborg (DK); Finn Jacobsen, Nordborg (DK)

(73) Assignee: Linak A/S, Nordborg (DK)

( * ) Notice: Subject to any disclaimer, the term of this patent is extended or adjusted under 35 U.S.C. 154(b) by 237 days.

(21) Appl. No.: 10/069,920

(22) PCT Filed: Sep. 4, 2000

(86) PCT No.: PCT/DK00/00484

§ 371 (c)(1),
(2), (4) Date: Mar. 1, 2002

(87) PCT Pub. No.: WO01/17401

PCT Pub. Date: Mar. 15, 2001

(30) Foreign Application Priority Data

Sep. 2, 1999 (DK) ..... 1999 01230
Mar. 31, 2000 (DK) ..... 2000 00534

(51) Int. Cl.[7] ..... A47C 19/04

(52) U.S. Cl. ..... 5/610; 5/618; 74/425; 74/325

(58) Field of Search ..... 5/610–618, 509.1; 74/421–425, 325

(56) References Cited

U.S. PATENT DOCUMENTS 5,566,412 A * 10/1996 Arnold ..... 5/610
5,901,610 A * 5/1999 Schneider ..... 74/421 A
6,000,077 A * 12/1999 Cyr ..... 5/618

FOREIGN PATENT DOCUMENTS

| | | |
|---|---|---|
| WO | 017399 | 3/2001 |
| WO | 0117400 | 3/2001 |
| WO | 0175334 | 10/2001 |

* cited by examiner

*Primary Examiner*—Lincoln Donovan
(74) *Attorney, Agent, or Firm*—Dykema Gossett PLLC

(57) ABSTRACT

A rotary actuator, in particular for adjustable articles of furniture, including beds or mattress supports, for incorporation in a structure for adjustment of an element in it, e.g. adjustment of a backrest section and/or leg-rest section in a bed or mattress support, said actuator comprising an electric motor (20) which is connected by a drive shaft with a transmission (21), which is in turn connected by a power take-off with a planetary gear having a sun wheel (54) connected with the power take-off of the transmission, first and second internally toothed outer rings (49) which are rigidly interconnected and have the same toothing, an internally toothed intermediate ring (50) positioned between the first and second outer rings so that it can rotate about its axis relative to the outer rings, a plurality of planet wheels (51) in engagement with the two outer rings and the intermediate ring and the sun wheel, and wherein the intermediate ring has a mounting bracket (11) for connection with one part of the structure, and wherein the outer rings or their rigid connection has a mounting bracket (12) for connection with the other part of the structure. A strong and comparatively noiseless as well as relatively inexpensive rotary actuator may be provided hereby. It may be constructed with a jamming protection arrangement and emergency lowering function.

33 Claims, 15 Drawing Sheets

SECTION E-E

Figure 1:
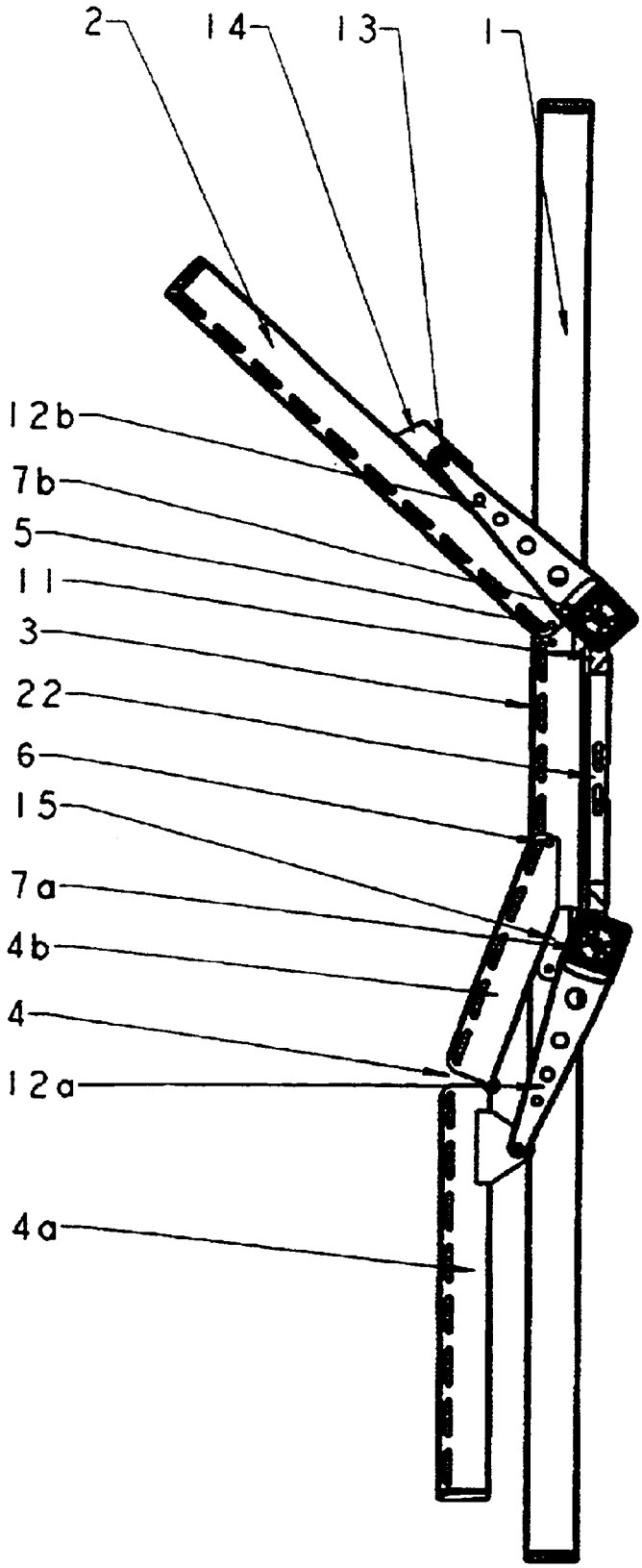

ROTARY ACTUATOR, ESPECIALLY FOR ADJUSTABLE FURNITURE, INCLUDING BEDS AND BOTTOM FOR BEDS

The present invention relates to a rotary actuator, in particular for adjustable articles of furniture, including beds or mattress supports, for incorporation in a structure for adjustment of an element in it, e.g. adjustment of a backrest section and/or legrest section in a bed or mattress support.

On beds, no matter whether they are hospital beds or care beds or mattress supports for domestic use having an adjustable head end and typically also an adjustable foot end, it is common that the adjustment is carried out by means of linear actuators. An example of a hospital bed is found in EP 498 111 to J. Nesbit Evans (the name has been changed to Huntleigh Technology Plc), and an example of an actuator is found in EP 577 541 to Linak A/S. A special embodiment for separate mattress supports is seen in DE 38 42 078 to Niko (the name has been changed to OKIN). The actuators require much space, which is a drawback particularly in beds and mattress supports for domestic use. It applies to hospital beds that these have to be washed from time to time, which takes place at a temperature of 65° C. in washing machines intended for the purpose. This makes special demands on the electrical adjustment mechanisms and the associated control equipment. These must inter alia be water-tight.

WO 99/40820 to Recticel discloses another example of an adjustment mechanism in which a tube shaft is rotated by means of a motor arranged at the end thereof. The structure has not been realized because of problems with the drive unit.

WO 92/20548 to Linvent AB discloses a drive of the above-mentioned type. This drive, which is based on a planetary gear structure, is particularly intended for front seats in cars, said drive serving as a mounting bracket for the backrest at one side and to adjust the inclination of the backrest.

In summary, the requirements to be met by adjustment mechanisms for beds are that they must have a relatively great strength, and that at the same time hey must be compact and comparatively noiseless as well as easy to mount. In addition, they must be capable of being constructed as a low volt structure. Further, the price must below.

The object of the invention is to provide a rotary actuator of the type mentioned in the opening paragraph which is capable of satisfying these different requirements. Also, it must be possible to manufacture the actuator at production costs which at least do not give a considerably higher price than the operationally reliable and well-tested linear actuators.

This is achieved according to the invention by a rotary actuator as defined in claim 1. It is hereby possible to use the same motor type as in linear actuators, i.e. a low volt motor having a relatively high number of revolutions which is reduced in the subsequent transmission. The planetary gear itself can be made relatively small and yet be able to transfer great forces, as the two outer rings distribute the forces more evenly in the gear and also support the planet wheels and the intermediate ring.

By providing the planetary gear with the number of teeth stated in claims 2–7 a high transmission reduction is achieved, and also a good transfer of forces may be achieved by shaping the planet wheels such that over their entire length they engage the toothed rims. It also simplifies the manufacture when the planet wheels have the same cross-section over the entire length. With the concretely stated number of teeth, a transmission of 1:53.2 is achieved. The central arrangement of the sun wheel has a stabilizing effect and also contributes to a good distribution of forces.

The two outer rings may be connected in various ways, e.g. with a combination of bolts and spacers, fishplates or integration in a tube member. Expediently, however, they are provided in or as a common housing which may readily be designed such that the mounting bracket may be secured on the end thereof. This gives an evident possibility of constructing the actuator such that it may be mounted at the end of a tube.

The actuator will readily be able to transfer the occurring forces if the planetary gear is made of machine steel and is tempered, but the manufacturing costs will be so high that the price per se will be an obstacle to the use of the actuator in furniture structures.

When, according to the invention, the planetary gear is made of sintered metal, a more reasonable production price may be achieved. The two outer rings may be made as two parts, each having a width, calculated in the longitudinal direction of the toothed rims, which is attractive for sintered metal manufacture, there being an upper limit to the height of the parts during pressing.

The two outer rings may be made as two halves which are assembled to a unit. Alternatively, two identical outer parts with an intermediate spacer, which also provides the opening for the mounting bracket of the intermediate ring. When the faces of the parts directed toward each other are formed with a pattern of male/female parts, these are secured against mutual rotation when they are clamped together. The splitting also makes it easier to manufacture the parts of sintered metal.

When, according to the invention, the parts with the two outer rings are made of plastics and the toothed rims themselves as an insert of sintered metal, a further reduction in the manufacturing costs may be achieved. It is hereby possible to make a single part of plastics with recesses for the toothed rims. To retain the toothed rims in the plastics part, the connection is provided as a splined connection so that the toothed rims may be inserted from the ends.

When, according to the invention, the ends of the toothed rims facing each other and the intermediate ring are formed with cooperating stepped arrangements, a good mutual control of these is achieved. The stepped arrangements are expediently made as a single step in that the toothed rims have an internal step at one end and an external step at the opposite end. The part will hereby have the same height throughout, which is advantageous for sintering.

In an embodiment, the planet wheels are made of sintered metal and carried by a steel shaft. In that case, however, it has been found advantageous to provide the planet wheels with a bearing bushing. The planet wheels are relatively long and border on what is possible with sintered metal. A better accuracy is achieved by making the planet wheels as two halves and assembling these on the shaft.

In an embodiment of the actuator according to the invention, the mounting brackets of the two outer rings and the intermediate ring are formed as arms for connection with the movable part and the stationary part, respectively, of the structure in which they are to be incorporated. Expediently, the arm of the outer rings is formed by plate material, mounted on a free end of one of the two outer rings. The arm of the intermediate ring is likewise expediently formed by a plate, the actual toothed rim being formed as an insert inserted into a recess in the plate material. In terms of costs, this is less expensive than making the intermediate ring and the arm as an integrated unit of sintered metal. A special structure consists of two relatively thin plates with flared edges and hole rim and assembled with the plane sides against each other. The flared hole rim simultaneously serves as a good guide for the insert of sintered metal. In the pressing, the flared hole rim may be formed with a spline for the fixing of the insert, which is formed with a corresponding spline. If the conditions of load permit; the arm may also be made of plastics, optionally with a single embedded metal plate as a support. For reasons of strength, however, it has been found expedient to make the arm of a stack of punched metal plates, preferably three. Another option is to make the arm of a thick laser-cut plate.

It will be appreciated that the actuator may be constructed such that the outer rings are fixed in the structure in which the actuator is to be incorporated, while the intermediate ring drives the movable element in the structure. The actuator may also be constructed conversely, so that the intermediate ring is fixed, while the outer rings drive the movable element.

According to the invention, the actuator is driven by an electric motor. This is typically a low volt motor according to the power current regulation, i.e. below 42.4 volts. A step-down transmission is typically interposed between the motor and the furniture drive, as the motor usually has a high number of revolutions. The motor and the transmission are expediently secured to a free end of one of the two outer rings, preferably so that the motor, the transmission and the outer rings are arranged on a common axis. This structure makes the actuator suitable for mounting at the end of a tube, e.g. so that the outer rings and the intermediate ring are disposed externally of the tube end, while the transmission and the motor are disposed inside the tube. However, the actuator may also be constructed such that also the outer rings and the intermediate ring are disposed completely inside the tube. The mounting bracket of the intermediate ring is then constructed as a carrier in engagement with the tube. This, internal arrangement provides a good possibility of achieving a moisture- or water-tight structure.

When, according to the invention, the motor is provided with radially protruding legs of an elastic material, preferably in the form of a belt with protruding legs which are pushed inwardly over the motor, said leas being intended for cooperation with the inner side of the tube into which the motor is inserted, a simple and vibration-damping support of the motor is achieved.

The subclaims define additional expedient structures of the actuator, and the advantages of these will appear from the description of the embodiment of the invention.

Figure 2:
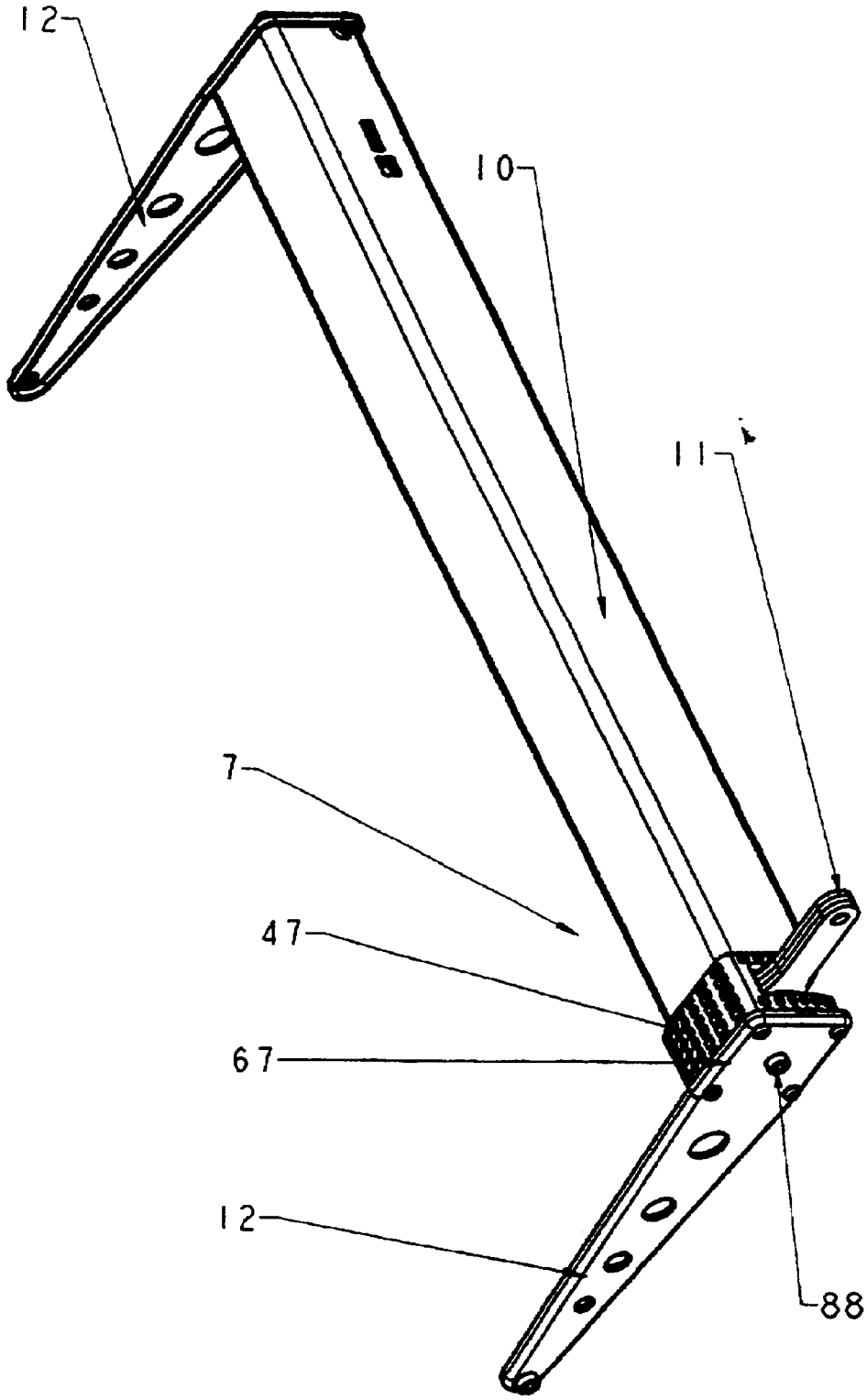
Figure 3:
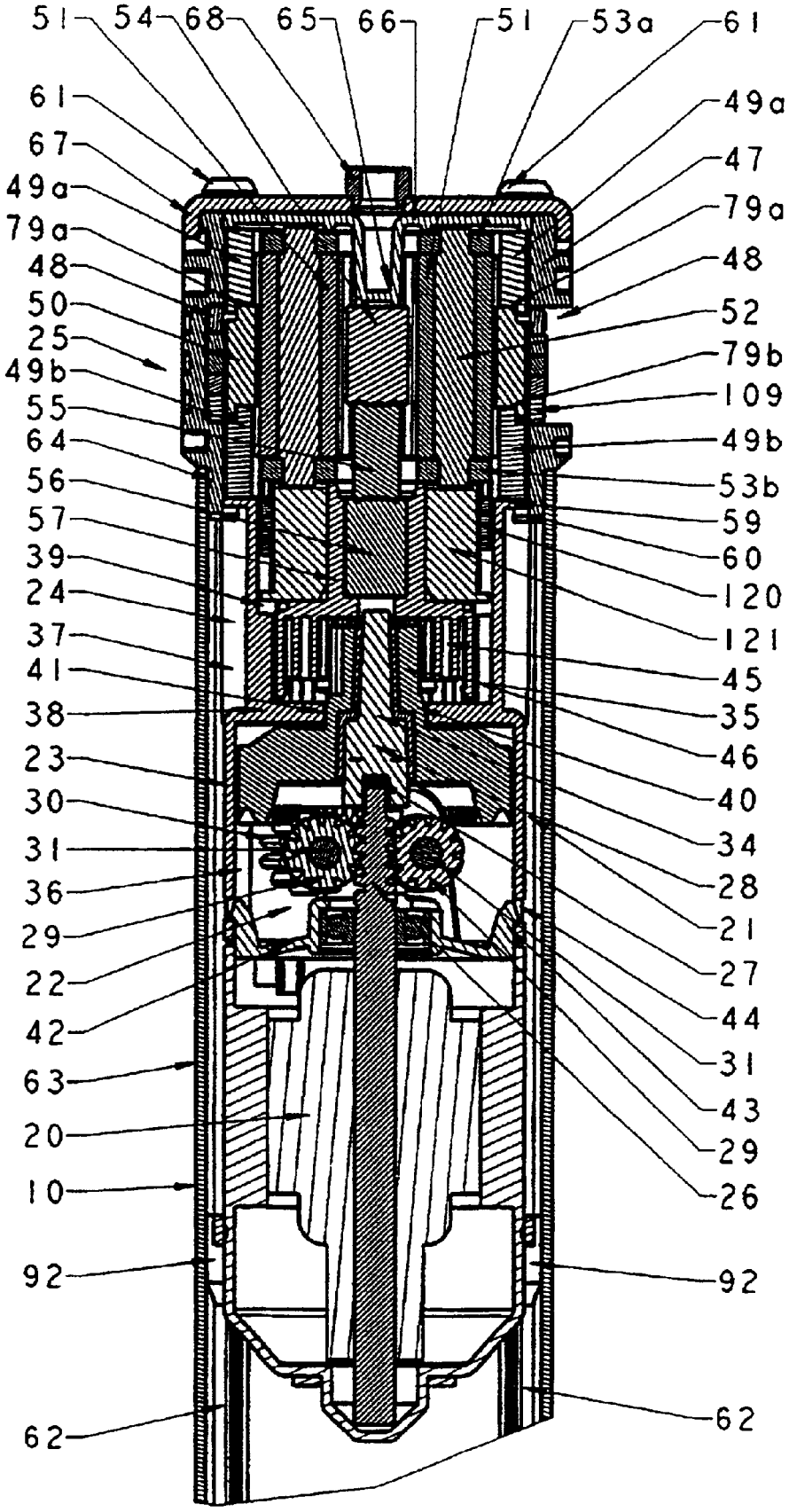
Figure 5:
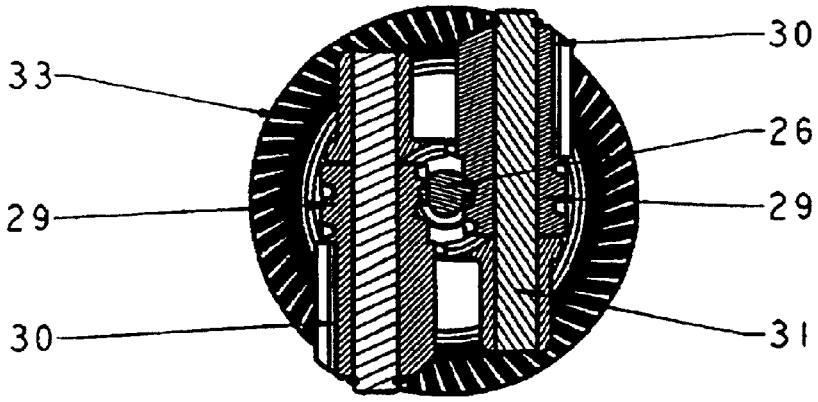
Figure 4:
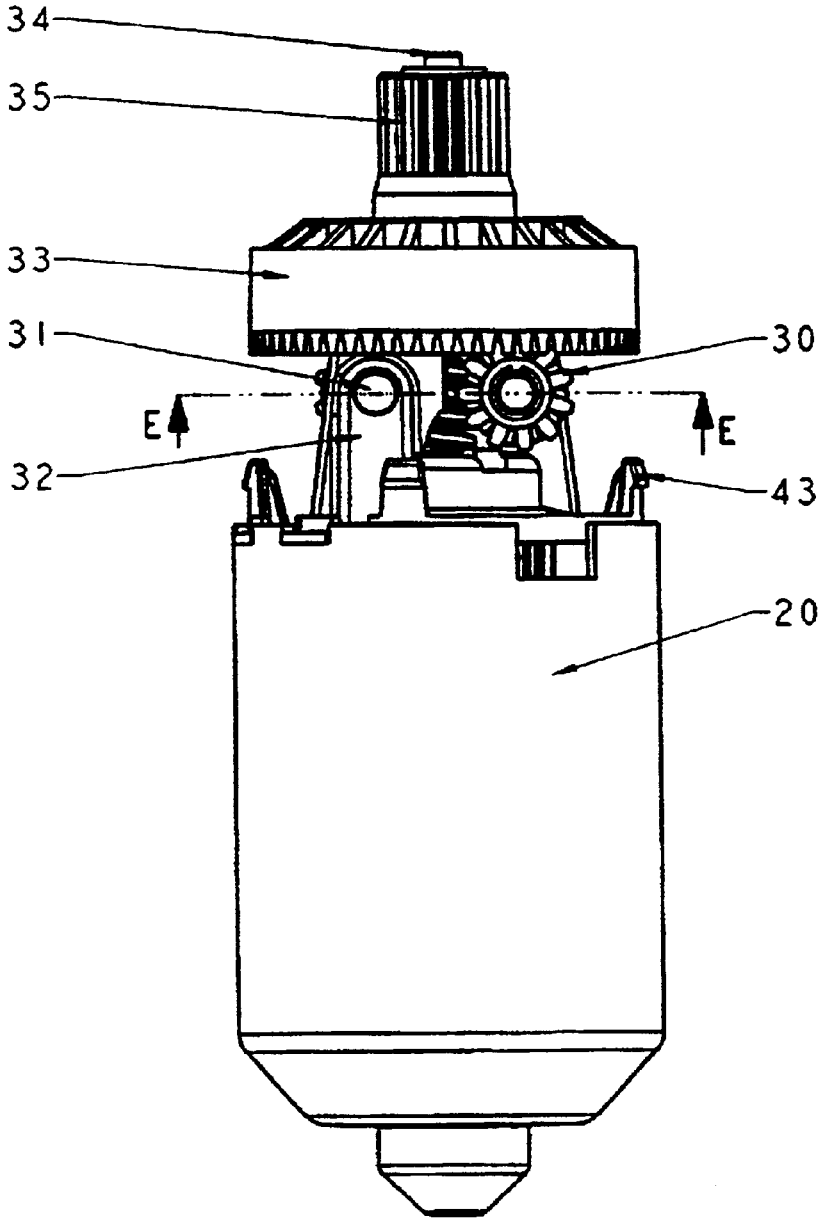
Figure 6:
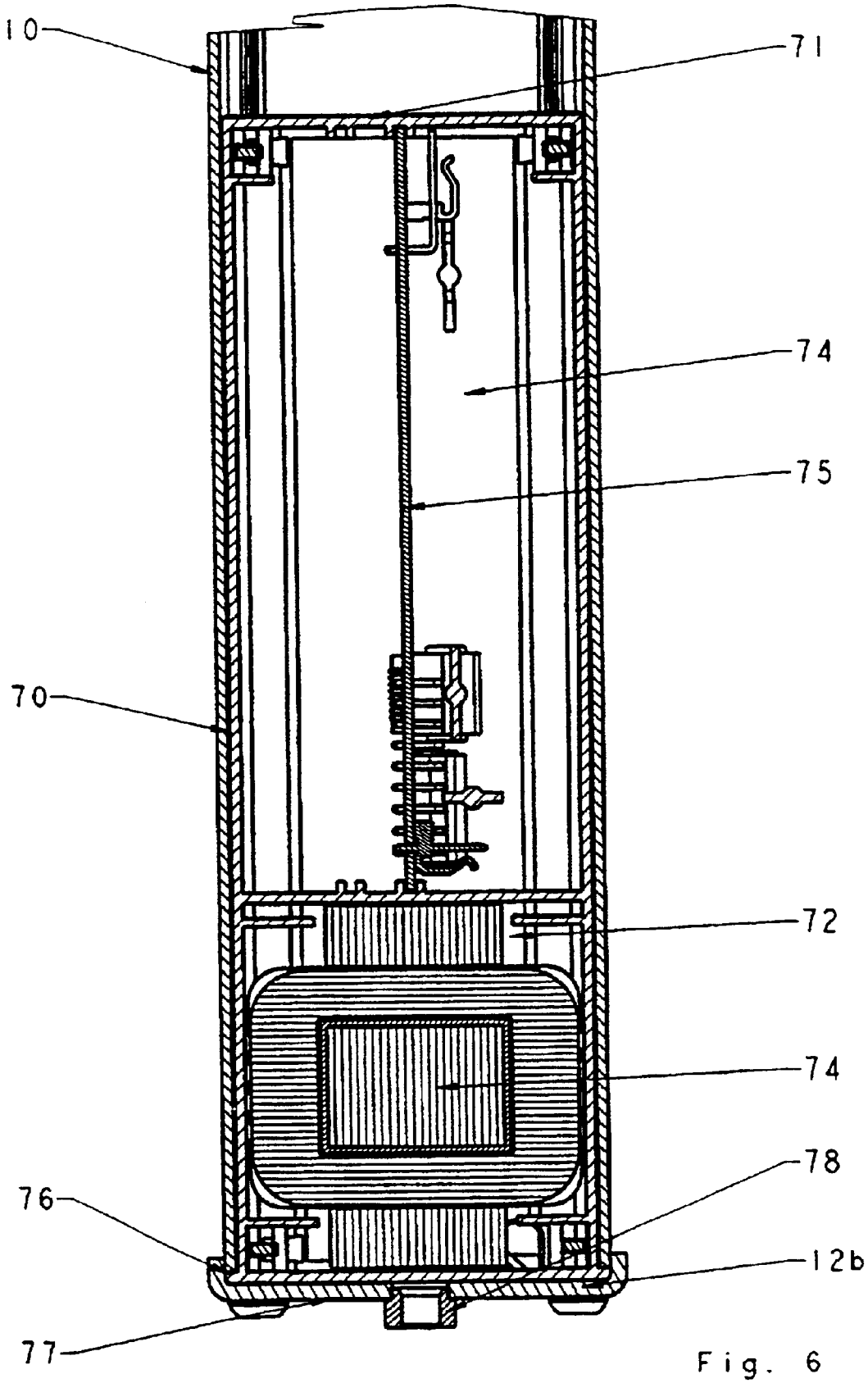
Figure 7:
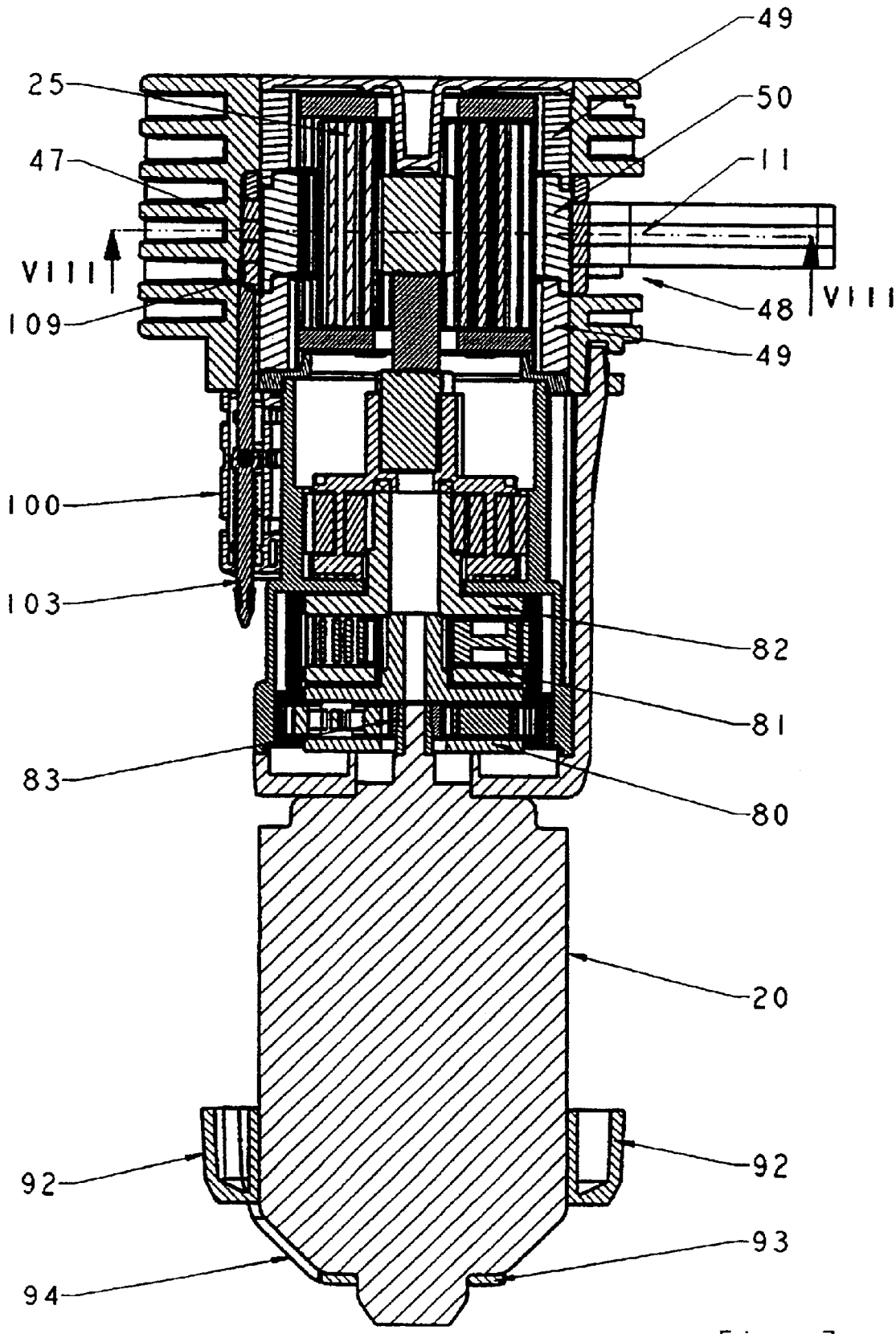
Figure 8:
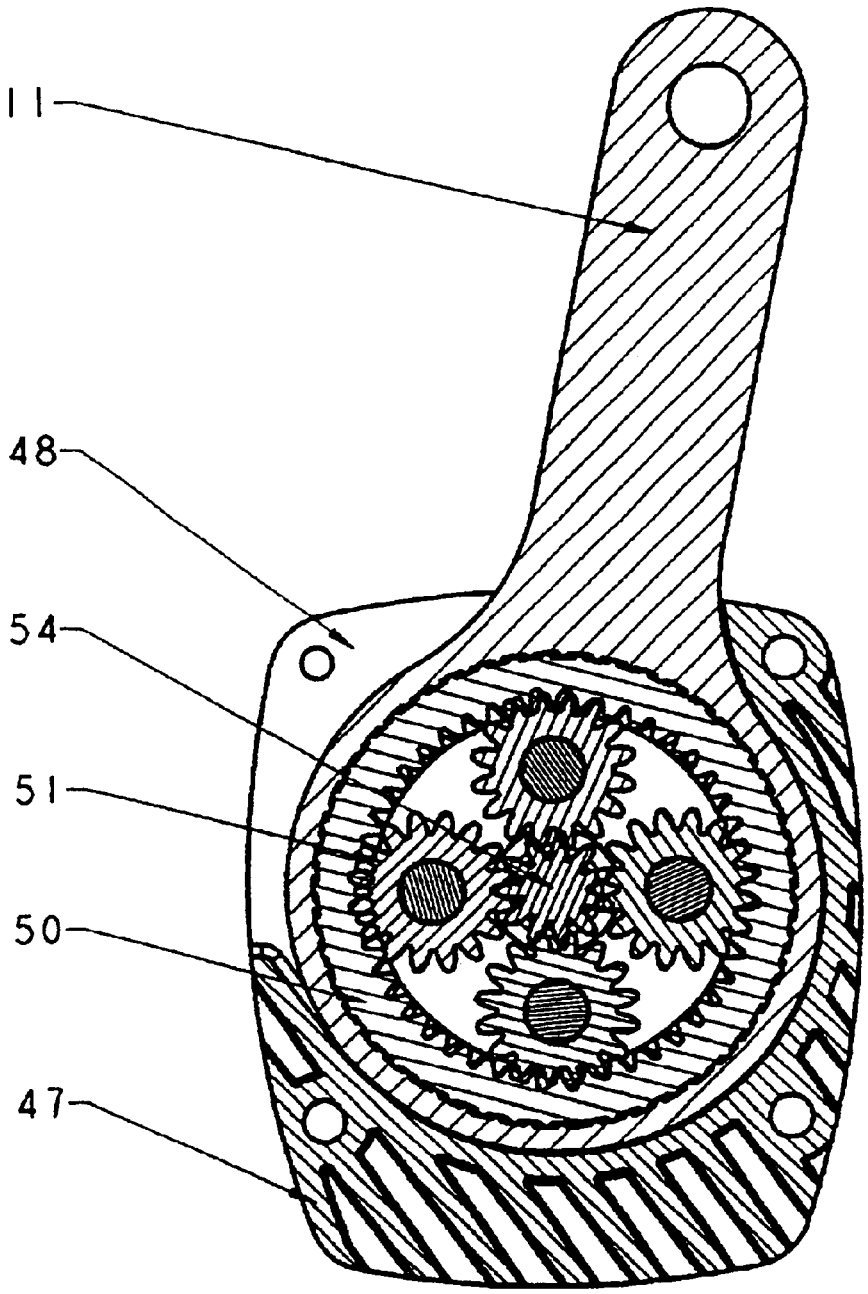
Figure 9:
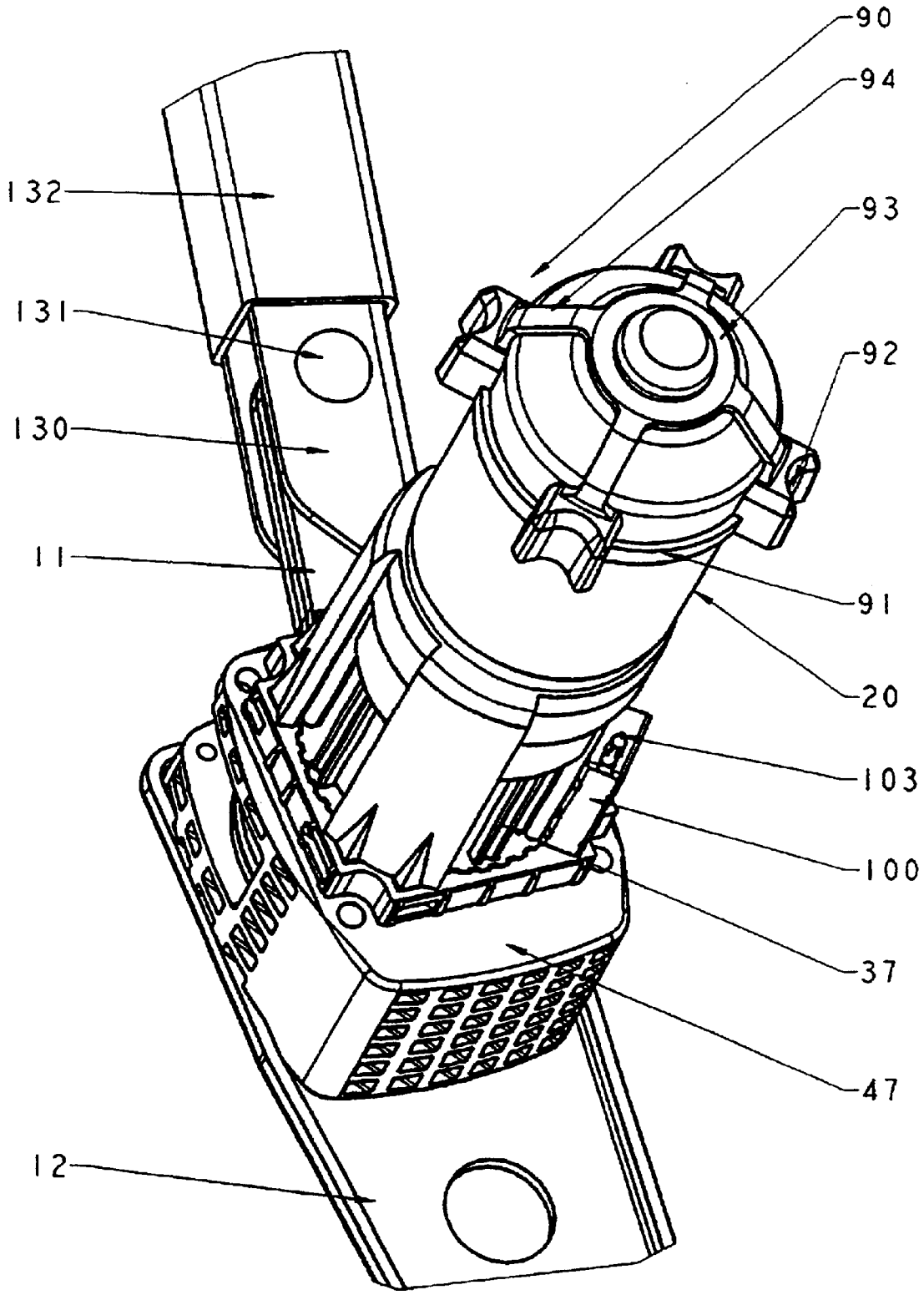
Figure 10:
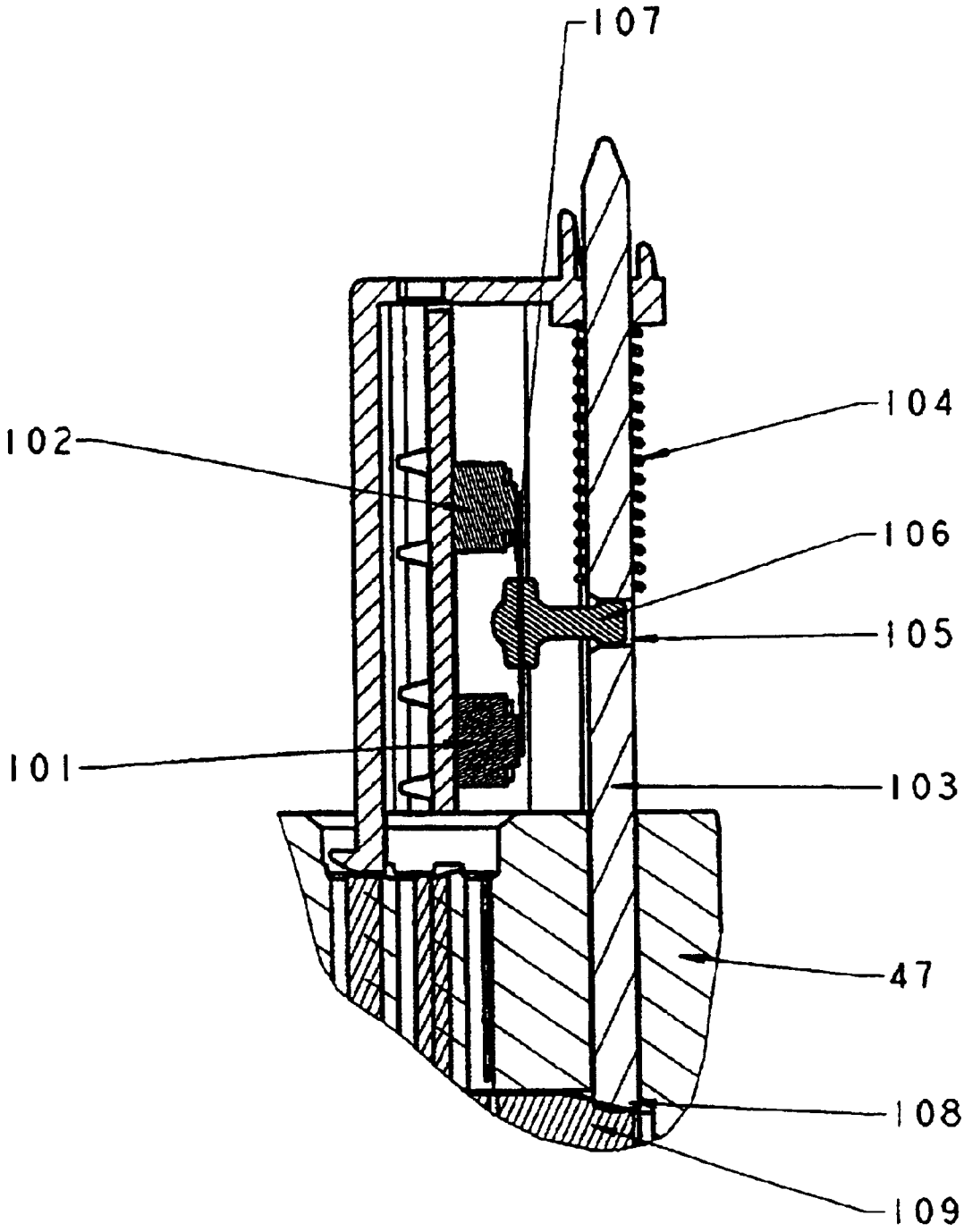
Figure 11:
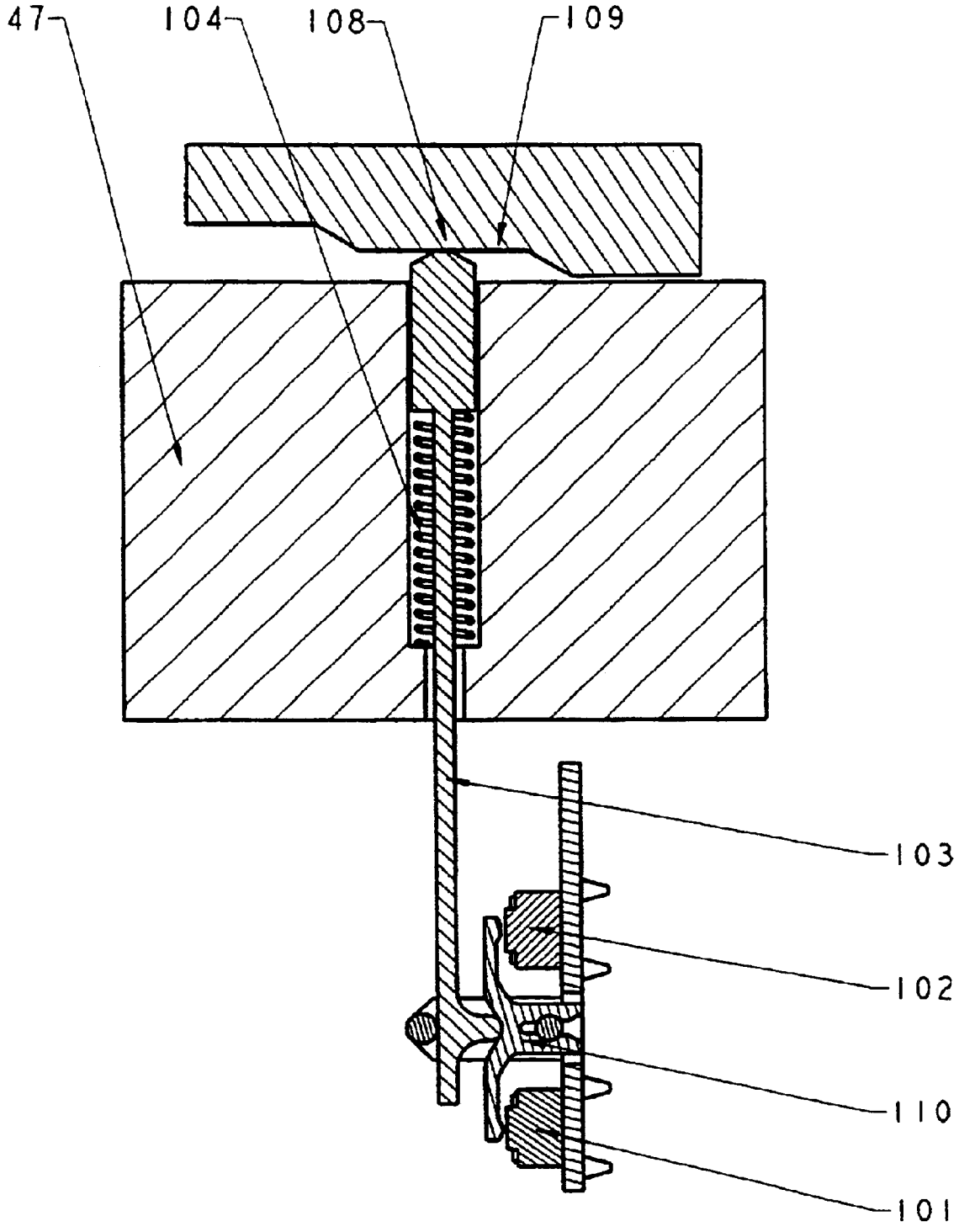
Figure 12:
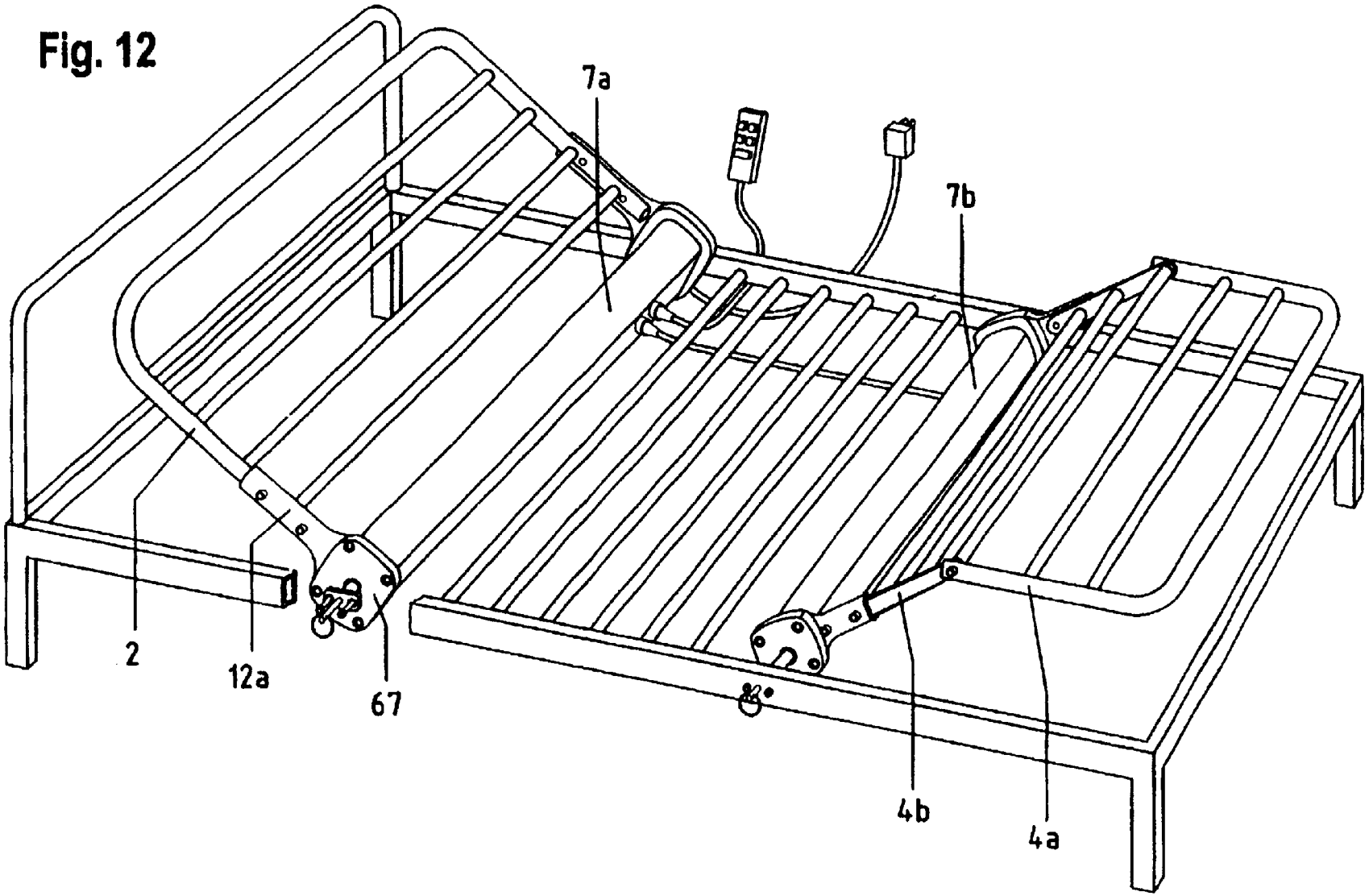
Figure 13:
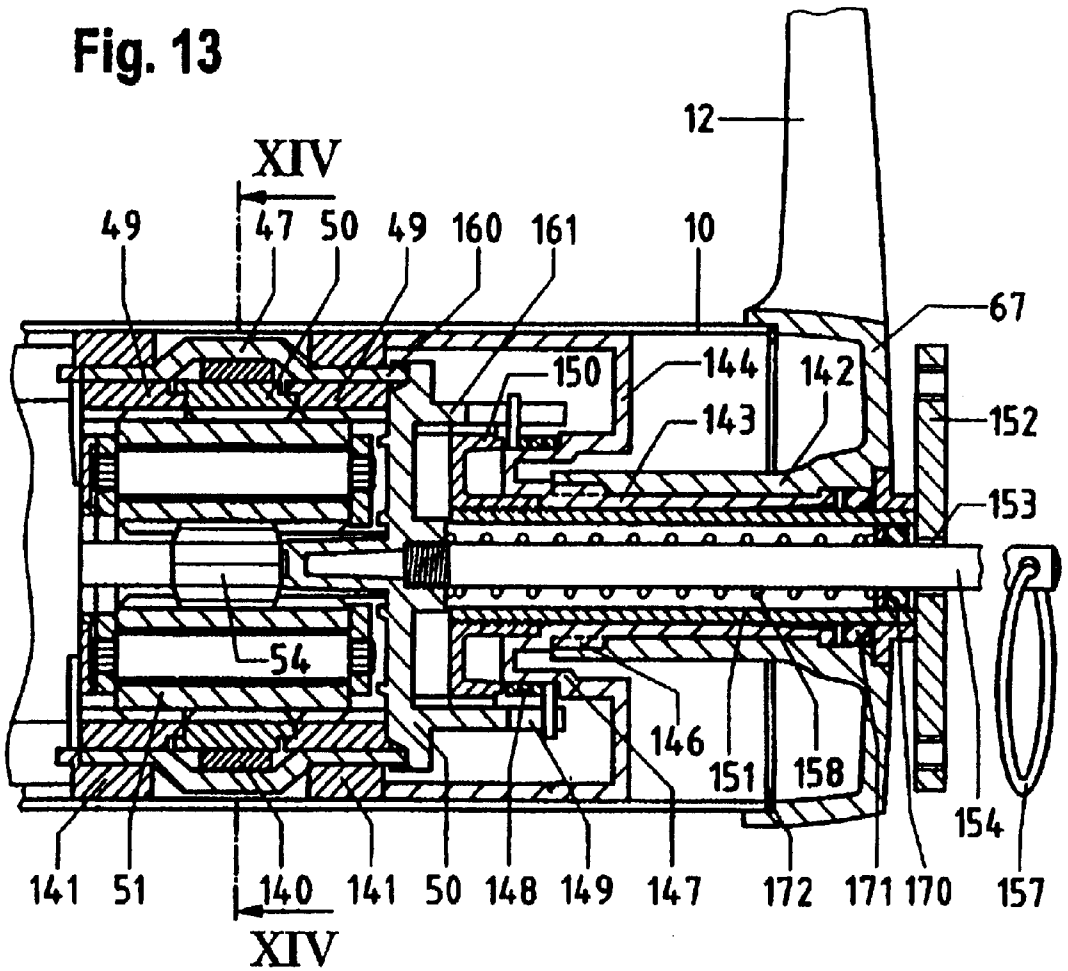
Figure 14:
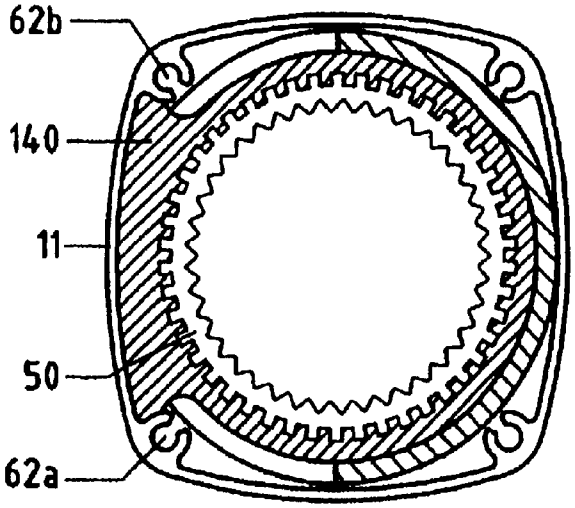
Figure 15:
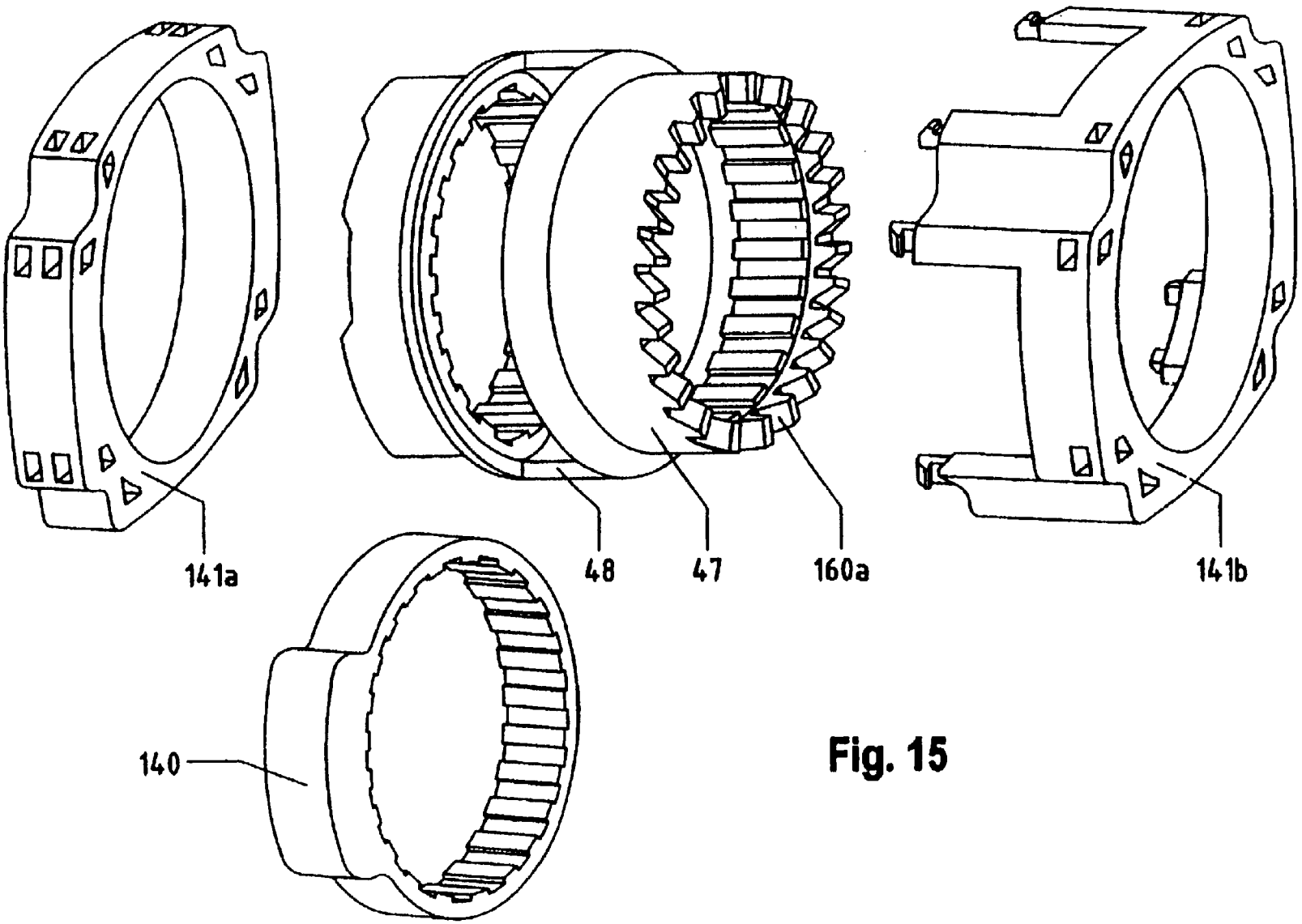
Figure 16B:
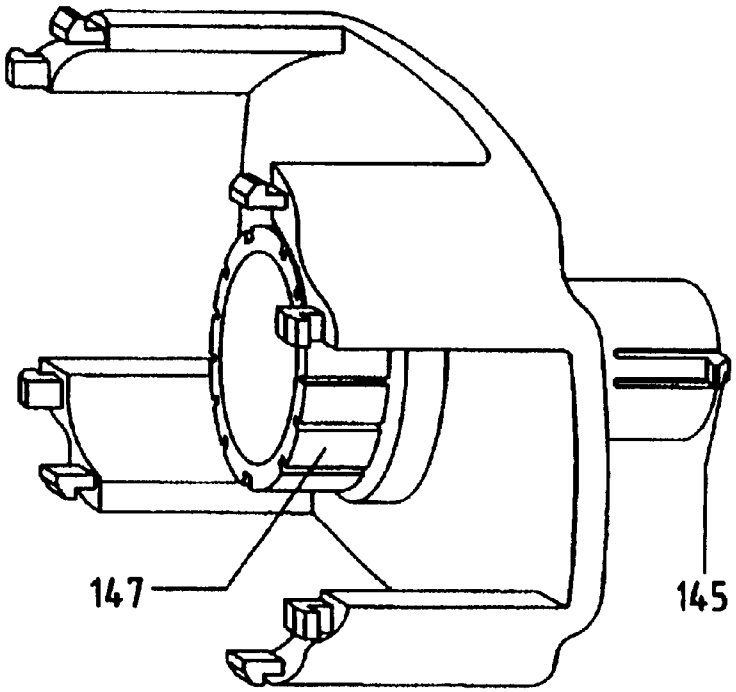
Figure 16A:
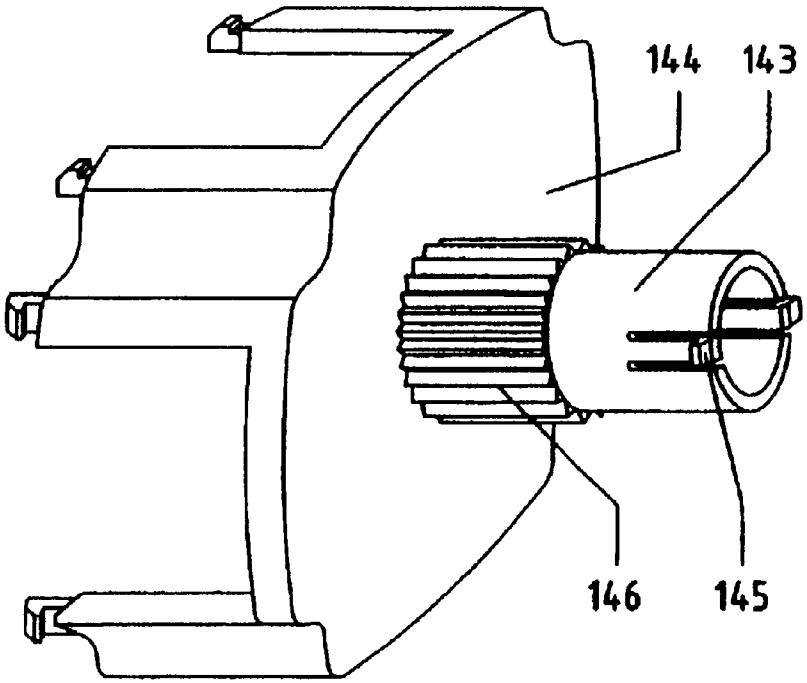
Figure 17:
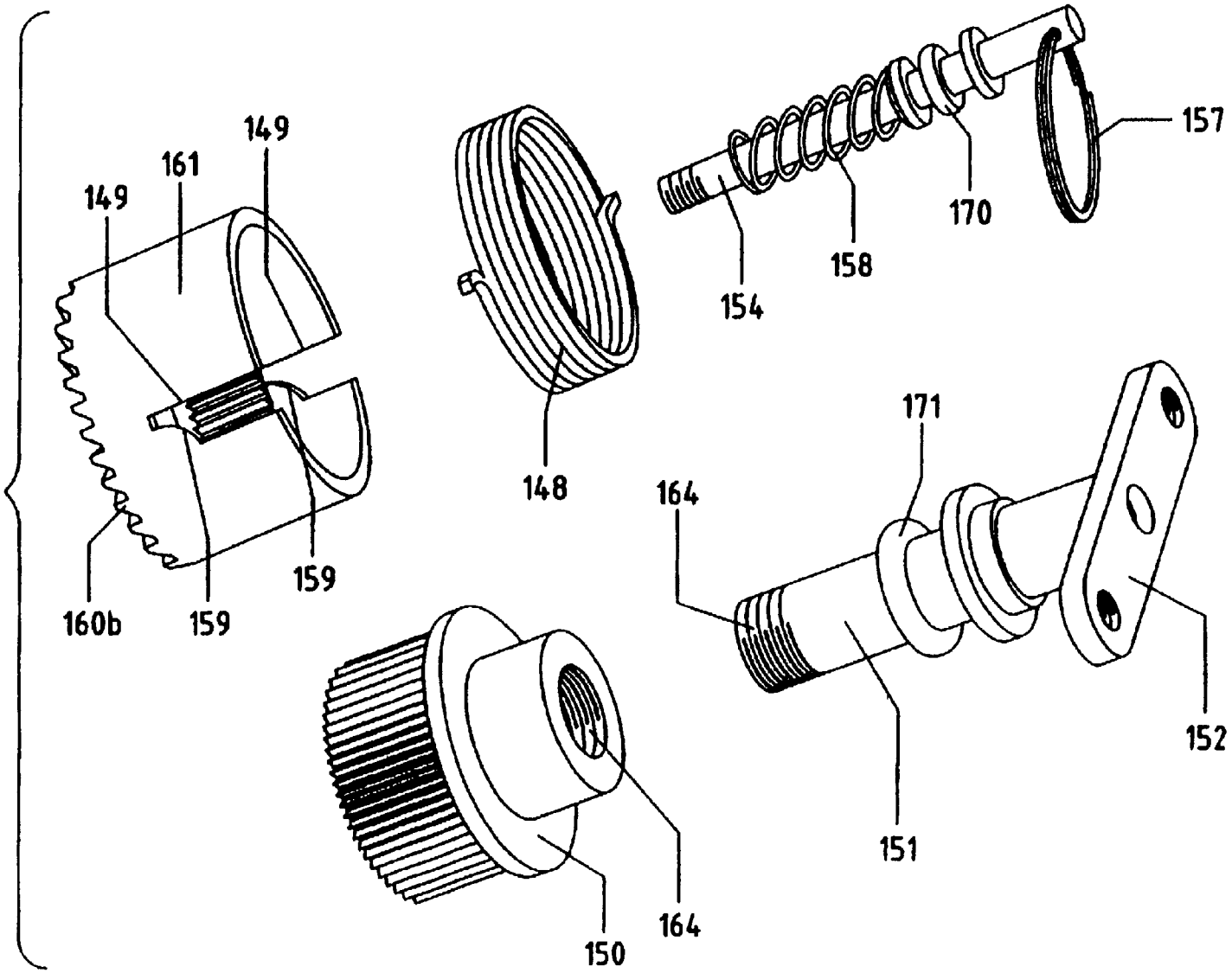

The invention will be explained more fully below with reference to the embodiment illustrated in the accompanying drawing. In the drawing:

FIG. 1 shows a mattress support intended to be placed or incorporated in a bed, FIG. 2 shows a rotary actuator in its entirety, FIG. 3 shows a longitudinal section through the drive unit of the actuator, FIG. 4 shows a lateral view of the motor with the two first links in the transmission, FIG. 5 shows a cross-section of FIG. 4 through worm/bevel wheels seen inwards toward crone wheel, FIG. 6 shows a longitudinal section through the end of the tube with power supply and control electronics, FIG. 7 shows a longitudinal section through another embodiment of the rotary actuator according to the zone invention, FIG. 8 shows a section along the line VIII—VIII in FIG. 7, FIG. 9 shows a perspective view of the actuator in FIG. 7 from the motor end, FIG. 10 shows a longitudinal section through end stop switches, FIG. 11 shows a longitudinal section through another embodiment of the end stop switches, FIG. 12 shows a perspective view of a bed with another embodiment of the rotary actuator according to the invention, FIG. 13 shows a longitudinal section through the outer part of the drive of the actuator, FIG. 14 shows a cross-section along the line XIV—XIV in FIG. 13, FIG. 15 shows an exploded view of parts of the outer planetary gear, FIG. 16*a* shows a perspective view of a part for the drive, FIG. 16*b* shows the same as FIG. 16*a*, but seen from the other end, and FIG. 17 shows an exploded view of parts for the drive.

The mattress support shown in FIG. 1 comprises an outer frame 1 which includes a mattress support portion consisting of a pivotable backrest part 2, a fixed central part 3 and a legrest part 4 which is articulated. The central part 3 is fixedly mounted on the sides of the outer frame 1.

The backrest part 2 is pivotable about a shaft 5 secured at the sides of the outer frame 1, and correspondingly the legrest part is pivotable about a shaft 6. Both the backrest part 2 and the legrest part 3 may be adjusted by a rotary actuator 7, as shown in FIG. 2. The rotary actuator comprises an extruded aluminium tube 10 of square cross-section, at whose one end there is a drive unit with a driven arm 11. An arm 12 is secured at each end of the tube 10, and, at the end with the drive unit, the arm is secured to the outer side thereof. At the backrest part 2, the arm is equipped with a wheel 13 which is guided in a guide rail 14 secured to the backrest part. The tube 10 is rotatably mounted about its longitudinal axis in a bracket 15 secured at each side of the outer frame 1. As the other arm 11 of the actuator is fixed, the tube 10 and the arms 12 secured on the end thereof will rotate when the actuator is activated. The arms 12 will hereby raise or lower the backrest part, as this will pivot about its shaft 5. The legrest part is raised or lowered in a corresponding manner, as the ends of the arms 12*a* on the actuator 7*b* of the legrest part are rotatably secured to a bracket on the outermost link 4*a* of the legrest part. Activation of the actuator will cause the legrest part 4 to be raised or lowered, as the arm 12*b* will cause the innermost link 4*b* to rotate about the shaft 6 through a raising and rotating movement of the outermost link 4*a* of the legrest part.

As will appear from FIG. 3, the drive unit consists of an electric motor 20, a transmission 21 consisting of three links 22, 23, 24 and finally a specially constructed planetary gear 25 with the arms 11, 12. The two first transmission stages 22, 23 are integrated in the front cover of the motor. The first stage is a worm gear where the worm 26 is provided in an extension of the motor shaft. The end of the worm is guided in a sliding bearing 27 in a bracket 28. The worm drives two pairs of worm wheels 29 arranged on their respective sides of it. The worm wheels are moulded integrally with a bevel wheel 30. Worm/bevel wheels 29, 30 are mounted on a shaft 31 which is arranged in a bracket 32 on the front cover. The worm wheels drive a crown wheel 33 mounted on the end of the bracket 28, which is formed as a journal 34. The crown wheel is moulded integrally with a sun wheel 35, and the unit is secured on the journal by a locking washer. All the gear wheels are moulded of plastics material, while the worm is of steel.

The two first transmission steps 22, 23 are contained in a first chamber 36 in a housing 37 with an intermediate wall 38 to a second chamber 39. The outer end of the crown wheel extends through a bore 41 in the intermediate wall 38: The housing as a whole is secured on the front cover 42 of the motor by snap lock connections in the form of snap locking legs 43 on the cover which engage mating recesses 44 in the side wall of the housing.

The third stage 24 in the transmission is formed by an ordinary planetary gear, where the sun wheel is formed by the sun wheel 35 on the crown wheel of the preceding link. The sun wheel engages a planet wheel 45, which is in turn in engagement with an internal toothing 46 in the housing.

The next member is the outer planetary gear 25 consisting of a plastics housing 47 with an opening for the arm 11. The housing accommodates two outer rings 49 secured against rotation in the housing through a splined connection. A free rotatable intermediate ring 50 is arranged between the two outer rings 49. The rinds are made of sintered metal, and on the edges facing each other they have a stepped arrangement 79 for controlling the intermediate ring. The arm 11 is made of three joined steel plates in which a hole has been punched for the intermediate ring 50. The intermediate ring and the arm are likewise connected in a non-rotatable manner through a splined connection. The outer rings 49 have an internal toothing with 41 teeth and the intermediate ring 50 an internal toothing with 45 teeth. Four planet wheels are engaged with the rings 49, 50 and have the same toothing over the entire length, viz. 16 teeth. The planet wheels are made of sintered metal and with a bushing of plastics mounted on a steel shaft and assembled on steel ring at each end. The planet wheels 51 are engaged with a sun wheel 54 likewise of sintered metal and positioned centrally in the planetary gear to achieve as even a distribution of the forces therein as possible. The sun wheel is welded on a short steel shaft 55, and a solid cylinder member 56, likewise of sintered metal and having a toothing, is welded on the other end thereof. The planetary gear is connected with the preceding transmission 24 in that the cylinder member 56 is receiver n a non-rotatable manner in a well 57 integrated with the planet wheels in the transmission 24. The sun wheel 54 is kept in position by the bottom of a well 65 on an intermediate cover 66, which also retains the external outer ring 49*a*. The entire plastics housing 47 is terminated by an end cover 67 provided at the end of the arm 12*a*. The cover part 67 of the arm accommodates a bearing bushing 88 for attachment to the bracket 15 on the bed frame.

The outer planetary gear 25 is secured on the other part of the drive by a collar 59 on the housing 37. This collar also keeps the internal outer ring 49*b* in position. The collar is secured by a snap lock 60 in the plastics housing 47 of the planetary gear.

It will thus be appreciated that the entire drive with motor, transmission and outer planetary gear constitutes a unit which is secured by screws 61 on the end of the aluminium tube 10, the screws being screwed into screw channels 62 at the internal corners of the aluminium tube. In the present case, an intermediate member 63 is interposed between the aluminium tube 10 and the plastics housing 47. As will appear, for fixing purposes, the plastics housing 47 has a neck 64 which fits the end of the intermediate member 63.

With reference to FIG. 6, a cabinet 70 is inserted at the other end of the tube 10, said cabinet having a cross-section which matches the internal cross-section of the tube. The cabinet consists of a lower part 71 with a cover and is divided into two compartments 72, 73, one containing the transformer 74, the other containing the control electronics 75. The end of the cabinet has a protruding edge 76 for engagement with the end of the tube. The whole is secured by the arm 12*b*, whose end is formed as a cover 77 secured by screws which are seated in the screw channels of the tube. The cover part 77 of the arm accommodates a shaft bushing 78 for attachment of the tube in the bed frame.

FIG. 7 of the drawing shows a slightly different embodiment of the rotary actuator according to the invention, and the same reference numerals as in the foregoing are used for the same parts. The embodiment essentially differs in that the transmission between the motor 20 and the outer planetary gear 25 is formed by a gear train consisting of three planetary gears 80, 81, 82, the motor shaft being provided with a sun wheel 83 in the first planetary gear. Otherwise, the planetary gears conventionally have sun wheels, planet wheels and an internally toothed rim. The toothed rims are here provided in the common housing. Also like before, the sun wheel in the outer planetary gear is coupled to the planet wheels in the last planetary gear 82.

The sun wheel 83 on the motor shaft, which is made of a relatively soft plastics material for reasons of noise, is moulded on a metal bushing with a knurling, carriers or the like for non-rotational mounting. This results in a better attachment on the motor shaft and also causes the heat to be conducted more effectively away from the plastics wheel, otherwise the soft plastics required for noise reduction could not be used.

For noise reduction, the gear train is of plastics. To achieve the desired gearing and to achieve a noise reduction as great as possible, it has been found expedient with the following gearings in the gear trains, where the first link has a gearing of about 1:6.8, the second link a gearing of about 1:5.8, and the third link a gearing of about 1:3.7, i.e. a total gearing of about 1:145.

To reduce the noise from the motor and to avoid the situation that this strikes against the inner side of the tube 10, the free end of the motor 20 inside the tube is fixed by a support 90 of rubber, cf. FIG. 9. The support consists of a ring 91 which is pushed inwardly over the end of the motor housing. The ring has four blocks 92 which, with a concave surface, are engaged with and are fixed against the screw channels in the corners of the tube. Rearwardly, the support has a ring 93 which engages the rear side of the motor. The two rings 90, 93 are kept together by four straps 94.

Reference is now made to FIGS. 9 and 10. For controlling the end positions of the actuator, the side of the housing 37 with the transmission has secured thereon a housing 100 having two end stop switches 101, 102 operated by a longitudinally slidable pin 103, which is spring-loaded by a coil spring 104 to a neutral position. The pin has a hole 105 which accommodates a rocker arm 106 in which a leaf spring 107 is mounted, said leaf spring engaging a push-button on the end stop switches 101, 102. The inner-most end 108 of the pin engages a cam face on the edge of a cam 109. This cam is secured to the side of the arm 11. It is indicated in FIG. 3 that on each side of the part of the arm 11 that accommodates the intermediate ring 50, two bearing rings are inserted into the housing 47, one of which bearing rings may be shaped as the cam, or it may be a separate element. At one end position the pin is moved to the right by the cam, causing the arm to press the leaf spring down on the switch 102 to the right and to activate it. At the other end position, the spring moves the pin to she left, causing the left-hand switch 101 to be activated. Therebetween, the pin is in a neutral position. The switches activate the control circuit to interrupt the current to the motor. The fraction of lag in the actuator contributes to ensuring that the cam does not run back so that the pin does not prematurely release its contact with the face concerned on the cam. A slightly different embodiment is shown in FIG. 11, where the spring 104 is mounted in a recess in the housing 47, and the leaf spring is replaced by a double rocker arm 110.

If the actuator does not posses the necessary self-blocking capacity for the arm to maintain the position concerned when the motor is switched off, then the actuator may be provided with a brake spring 120 in the form of a coil spring which, with a plurality of windings, here four, is wound around a cylindrical element 121 secured to the well 57 which connects the transmission with the outer planetary gear 25. One end of the spring is fixed in the housing. The braking force of the spring is adjusted so that it presents no or almost no resistance when the actuator is activated to raise the backrest part 2 or the legrest part 4 of the mattress support portion. When the current to the motor is interrupted, the spring will exert a sufficient braking force to keep the backrest part 2 or legrest part 4 in the given position. For lowering, the motor must merely use relatively modest energy to overcome the braking force.

Reference is now made to FIGS. 1, 2 and in particular 9. The actuators for the backrest part 2 and the legrest part 4 are positioned in the mattress support so that the arm 11 is on a straight line, which is possible in that the arms 11, 12 are symmetrical about their longitudinal axes. The arm is rotatable connected with a U-profile 130 by a bolt 131, said arm resting with one edge on the bottom of the U-profile. The other end of the U-profile 130 is slidably mounted in a tube 132 of quadrangular cross-section. This tube 132 connects the arms 11 of the two actuators with each other. When e.g. the backrest part actuator is activated, the torque will be accommodated in this connecting tube 132. If anything gets jammed between e.g. the backrest part 2 and the bed frame 1, the backrest part will stand still and the arm 11 will instead begin to rotate relative to the U-profile 130 and pull it outwards in the tube 132. The U-profile may be mounted loosely in the tube, or there may be a through bolt which is positioned through a slot either in the side wall of the tube or in the U-profile, so that the profiles cannot be pulled apart by accident. When the backrest part stands still, the user will quickly realize that something has got jammed and will be able to stop the actuator. To remove the object which is stuck, it may be expedient to move the backrest part slightly upwards. The same applies to the legrest part.

It is noted that the drawings of the actuator are substantially in the order of 1:1.

FIGS. 12–17 of the drawing show another embodiment of the actuator according to the invention where the drive unit is arranged entirely within the tube. The motor and the transmission are not shown in the figure, which just shows the outermost part with the outer planetary gear 25. The same reference numerals are used for the same components. Here too, the two outer rings 49 are mounted in a housing 47, which is here a cylindrical steel housing, and correspondingly to the previous example the intermediate ring 50 is mounted between the two outer rings. The mounting bracket of the intermediate ring 50 is here shaped as a carrier 140 in the form of a fin in engagement with the inner side of the tube in engagement between two screw channels 62*a*, 62*b*. The planetary gear is centered in the tube with two bearing rings 141*a*, 141*b*. One bearing ring 141*b* is provided with snap locking legs for coupling the two rings together. The end of the tube is likewise closed by a cover part 67 of the arm 12. The cover part here has an internal tube part 142 which is positioned over another tube part 143 on a cap 144. The two tube parts are mutually secured by snap locking means 145 and are additionally mutually non-rotatably fixed via a toothed connection 146. The cap 144 is provided with snap locking legs and is secured at the end of the ring 141*b*. For the sake of illustration, however, the cap is shown in FIGS. 16*a*, 16*b* in a slightly other embodiment than the one shown in FIG. 13.

The actuator is also provided with an emergency lowering device or quick release device based on a coupling spring 148 mounted on a cylindrical part 147 of the cap. The coupling spring 148 is mounted at its ends in incisions 149 in a cylindrical wall 163 on the intermediate cover 56, in which a connecting element 56 is additionally arranged. This ring engages the ring on the end cover 163 by a toothing. For the sake of good order it is noted that the structure of this in FIG. 17 is slightly different from the one shown in FIG. 13. The cylindrical tube part 143 accommodates a tube shaft 15 connected with a bracket 152 for mounting on the bed frame with screws. A stem 154 extends through a central hole 153 in the bracket and is screwed into a hole in the intermediate cover 56 with its innermost end, while the other end of the stem 154 extends beyond the side of the bed frame and is provided with a pull ring 157. A coil spring 158, which keeps the intermediate cover 56 in position, is provided around the stem 154. In ordinary operation, the outer rings 49 stand still, while the intermediate ring 50 moves and, via the carrier 140, rotates the tube and thereby the arm 12 to raise and lower the backrest part 2 or the legrest part 4 of the mattress support.

Furthermore, a jamming protection arrangement is provided in the actuator in that the edge of the housing 47 and the rim of the intermediate cover 156 have cooperating carrier teeth 160. When the backrest part 2 or the legrest part 4 is raised, the teeth with axial or approximately axial faces are in mutual engagement. When the backrest part 2 or the legrest part is lowered, the teeth tread on each other with an inclined face. If anything gets jammed, the teeth will ride on each other, and the intermediate cover 56 will be urged away against the spring force which keeps the two sets of teeth in engagement. By the sound of the two sets of teeth riding on each other, and because of the circumstance that the backrest part or the legrest part stands still, the user will realize that something has got jammed. Like before, the part is moved slightly upwards to facilitate removal of the jammed object.

The emergency lowering arrangement operates as follows: In case of an emergency situation where the backrest part 2 or the legrest part 4 is to be lowered, the stem 154 is pulled out, thereby causing the coupling spring 148 to be tightened. Normally, the ends of the spring are seated in the wide part of the incisions 149 in which a cam face 159 is provided such that the more the stem is pulled, the greater the coupling force is. This results in a controlled lowering of the backrest part 2 or the legrest part 4. For better understanding of the quick release function and the jamming protection, some parts of the structure are shown in FIG. 17. It is noted that these correspond to FIG. 14 in terms of function, but the cylindrical part on the intermediate cover 56 is here shaped as a ring 161 which accommodates an insert 150, again connected non-rotatably with a toothed connection. The tube shaft 151 is here screwed into the insert 150 with the threads 164. The coupling spring. 148 is loose on the cylindrical part 147 of the cap in normal operation, i.e. there is no rotational connection with the outer ring 49 via the ring 161 of the intermediate cover. When the stem 154 is pulled, the intermediate cover 50 is disengaged from the housing 47, and the coupling spring 148 is tightened to firmly grip the cylindrical part 147 on the cap 144. Via the frame, the arm 12 will now be free to rotate down to the starting position. It is intended that it must take a certain weight to rotate the arm downwards. The size of the weight may be determined by the diameter of the spring, which is obtainable in jumps of ranges down to 1/10 mm.

As will readily be appreciated, this embodiment of the rotary actuator is extremely easy to make watertight. This can be done solely with the O-rings 170, 171 and the gasket 172: This embodiment of the actuator, which is watertight (IP66), and which has jamming protection and controlled emergency lowering, is thus suitable for hospital beds.

It will be appreciated that the invention may be realized in other connections than beds or mattress supports, and it will also be appreciated that the invention may be implemented in various embodiments. The rotary actuator is expediently constructed as an independent component intended for direct incorporation in a furniture structure, which should here be understood in the broadest possible sense. Be it articles of furniture for private dwellings, institutions, hospitals, health centres, dental clinics, seats for vehicles, etc. The use of the actuator, however, is not limited to this, as it may also be used in machines, implements, process equipment, and in buildings, e.g. to open windows, doors.

The actuator is here illustrated with a tube shaft and with in-line motor and transmission, but it will be appreciated that the embodiment may be adapted as desired. For example, the motor may be arranged axis-parallel with the planetary gear, and the transmission may be arranged in the vertical plane at the end of these. The whole may then be encapsulated in an almost quadrangular housing. It is also evident that the actuator may be provided as indicated in FIG. 3 in a short tube member in which an end cover is mounted at the end thereof.

What is claimed is:

1. A rotary actuator, in particular for adjustable articles of furniture, including beds or mattress supports, for incorporation in a structure for adjustment of an element in it, e.g. adjustment of a backrest section (2) and/or legrest section (4) in a bed or mattress support, said actuator comprising an electric motor (20) which is connected by a drive shaft to a transmission which is in turn connected by a power take-off to a planetary gear (25) with a sun wheel (54) connected with the power take-off of the transmission, first and second internally toothed outer rings (49) which are rigidly interconnected (47) and have the same toothing, an internally toothed intermediate ring (50) positioned between the first and second outer rings so that it can rotate about its axis relative to the outer rings, a plurality of planet wheels (51) in engagement with the two outer rings (49) and the intermediate ring (50) as well as the sun wheel (54), and wherein the intermediate ring (50) has a mounting bracket (11) for connection with one part of the structure, and wherein the outer rings (49) or their rigid connection has a mounting bracket (12) for connection with the other part of the structure.

2. An actuator according to claim 1, characterized in that the planet wheels (51) have the same toothing at the two outer rings and at the intermediate ring, and that the outer rings (49) have a smaller number of teeth than the intermediate ring (50).

3. An actuator according to claim 2, characterized in that the planet wheels (51) have the same cross-section over their entire length.

4. An actuator according to claim 2, characterized in that the outer rings (49) have a number of teeth smaller than the intermediate ring (50) corresponding to the number of planet wheels (51).

5. An actuator according to claim 3, characterized in that the outer rings have 41 teeth and the intermediate ring 45 teeth, and that four planet wheels are provided.

6. An actuator according to claim 5, characterized in that the planet wheels have 16 teeth and the sun wheel 11 teeth.

7. An actuator according to claim 1, characterized in that the sun wheel (54), seen in the longitudinal direction of the actuator, is arranged in the centre of the planetary gear.

8. An actuator according to claim 1, characterized in that the two outer rings (49) are provided in or as a common housing (47).

9. An actuator according to claim 1, characterized in that the two outer rings are made as two parts, and wherein the faces of the parts directed toward each other are formed with a pattern of male/female parts engaging each other.

10. An actuator according to claim 8, characterized in that the two outer rings are made of plastics, preferably as a single part, and that the toothed rims of the two outer rings are formed as inserts of sintered metal, preferably secured by a splined connection.

11. An actuator according to claim 1, characterized in that the ends of the toothed rims facing each other are formed with cooperating stepped arrangements (79), expediently as a single step, in that the toothed rims have an internal step at one end and an external step at the other end.

12. An actuator according to claim 1, characterized in that the two outer rings (49, 50) and the intermediate ring are provided with their respective arms (11, 12) for connection with the movable part and the stationary part, respectively, of the structure in which they are to be incorporated, wherein the arm of the two outer rings is preferably of a plate member mounted on the outer end of the external outer ring, and wherein the arm of the other outer ring is likewise preferably formed by a plate, wherein the toothed rim itself is provided as a sintered metal insert inserted into a recess in the plate material.

13. An actuator according to claim 7, characterized in that the arm of the other outer ring consists of two relatively thin plates with flared edges and hole rim and assembled with the plane sides toward each other, and wherein the flared hole rim serves as a guide for the insert of sintered metal, and wherein arm and insert are mutually fixed preferably with a splined connection.

14. An actuator according to claim 1, characterized in that it is made or essentially made of sintered metal.

15. An actuator according to claim 1, characterized in that the motor (20) and the transmission (21) are in-line with the planetary gear, i.e. the pull shaft of the motor and the power take-off of the transmission are in extension of the sun wheel of the planetary gear.

16. An actuator according to claim 1, characterized in that the transmission is formed by a number of planetary gears (80, 81, 82) coupled together.

17. An actuator according to claim 1, characterized in that the transmission comprises a worm drive with a worm (26) and at least one worm wheel (29), wherein the worm is driven by the motor shaft, and wherein the worm wheel drives a bevel wheel (30), which in turn drives a crown wheel (33) with a power take-off, preferably in the form of a sun wheel (35) in a subsequent planetary gear.

18. An actuator according to claim 1, characterized in that it is incorporated fully or partly at the end of a tube (10), preferably of polygonal cross-section, preferably quadrangular cross-section.

19. An actuator according to claim 18, characterized in that the tube is of extruded aluminium at least with screw channels at the corners.

20. An actuator according to claim 18, characterized in that the planetary gear is positioned against the end of the tube and secured to it.

21. An actuator according to claim 20, characterized in that the outer rings are formed with screw holes for screw attachment of the actuator in the screw channels of the aluminium profile.

22. An actuator according to claim 18, characterized in that the planetary gear is positioned within the end of the tube, and that the mounting bracket of the intermediate ring is formed as; carrier in engagement with the profile.

23. An actuator according to claim 19, characterized in that the end of the tube opposite the actuator is provided with a mounting bracket corresponding to the mounting bracket on the outer ring of the planetary gear.

24. An actuator according to claim 18, characterized in that an actuator is provided at both ends of the tube, and that these are driven synchronously.

25. An actuator according to claim 1, characterized in that the intermediate ring is provided with a cam (109) having a cam face which cooperates with at least one switch (100) for controlling the electric motor.

26. An actuator according to claim 12, characterized in that it comprises an activation pin (103), preferably parallel with the axis of the planetary gear, which is spring-loaded (104) such that an end of the pin is in engagement with the cam, whose cam face is perpendicular to the axis of the planetary gear, said pin being additionally connected to at least one switch.

27. An actuator according to claim 13, characterized in that it comprises two end stop switches (101, 102) which are activated by the pin.

28. An actuator according to claim 14, characterized in that it comprises a leaf spring (107) which rests on the activation means of the end stop switches, and that the leaf spring is secured to the activation pin via a rocker arm, so that the leaf spring activates one switch when the pin is in one position and the other switch when the pin is in the other position.

29. An actuator according to claim 1, characterized in that it comprises a coil spring (120) which is fixed with one end and wound around a cylindrical element with a plurality of windings and arranged such that the spring allows free rotation or substantially free rotation in one direction of rotation of the element, but applies a braking force in the other direction of rotation of the element so that the actuator is self-blocking.

30. An actuator according to claim 1, characterized in that it comprises an activatable coupling for uncoupling of the intermediate ring or the outer rings.

31. An actuator according to claim 28, characterized in that the coupling is formed by a coil spring (148).

32. An actuator according to claim 28, characterized in that the coupling force is adjustable for controlled return of the actuator.

33. An actuator according to claim 18, characterized in that the power supply and the control electronics are incorporated in the tube, preferably in a cabinet (70) constructed for insertion into the tube end opposite the actuator.

* * * * *